US005900117A

United States Patent [19]

Lidar

[11] Patent Number: 5,900,117

[45] Date of Patent: May 4, 1999

[54] APPARATUS AND METHOD FOR CLEANING PAPERMACHINE CLOTHING

[75] Inventor: Per-Ola Lidar, Hogsjo, Sweden

[73] Assignee: Scapa Group PLC, Blackburn, United Kingdom

[21] Appl. No.: 08/817,517

[22] PCT Filed: Jan. 3, 1996

[86] PCT No.: PCT/GB96/00003

§ 371 Date: Apr. 17, 1997

§ 102(e) Date: Apr. 17, 1997

[87] PCT Pub. No.: WO96/21060

PCT Pub. Date: Jul. 11, 1996

[30] Foreign Application Priority Data

Jan. 5, 1995 [GB] United Kingdom ..... 9500109

[51] Int. Cl.[6] ..... D21B 1/02

[52] U.S. Cl. ..... 162/199; 162/275; 162/274; 162/278; 134/122 R; 134/64 R; 134/15; 68/44; 68/204

[58] Field of Search ..... 162/199, 274, 162/275, 278, 279; 134/122 R, 15, 64 R, 16; 68/44, 200, 201, 204; 15/302, 306.1, 307, 345, 316 R; 209/380

[56] References Cited

U.S. PATENT DOCUMENTS

| | | | |
|---|---|---|---|
| 1,501,179 | 7/1924 | Peacock et al. | 162/279 |
| 1,550,994 | 8/1925 | Vickery . | |
| 2,368,662 | 2/1945 | Jordan | 92/50 |
| 2,544,572 | 3/1951 | Vickery | 92/50 |
| 3,190,793 | 6/1965 | Starke | 162/278 |
| 4,822,454 | 4/1989 | Meirowitz et al. | 162/199 |
| 4,888,096 | 12/1989 | Cowan et al. | 162/358 |
| 4,943,451 | 7/1990 | Zimmer | 427/294 |

FOREIGN PATENT DOCUMENTS

| | | |
|---|---|---|
| 1141525 | 12/1962 | Germany . |
| 9218012 | 9/1993 | Germany . |
| 587684 | 5/1977 | Switzerland . |
| 900060 | 7/1962 | United Kingdom . |
| 2055409 | 3/1981 | United Kingdom . |
| 2138713 | 10/1984 | United Kingdom . |

*Primary Examiner*—Stanley S. Silverman
*Assistant Examiner*—José S. Fortuna
*Attorney, Agent, or Firm*—Jacobson, Price, Holman & Stern, PLLC

[57] ABSTRACT

A papermachine clothing cleaning apparatus has a fluid injection nozzle with an apertured plate (14). The injection nozzle directs fluid onto the papermachine clothing (11) in order to clean the clothing. The areas of papermachine clothing that are adjacent the areas of clothing being impacted by the fluid are located in a press formed by the apertured plate (14) and a body (15) provided at the opposite surface of the fabric (11).

20 Claims, 2 Drawing Sheets

APPARATUS AND METHOD FOR CLEANING PAPERMACHINE CLOTHING

This application is a 371 of PCT/GB96/00003 filed on Jan. 3, 1996.

BACKGROUND OF THE INVENTION

1. Field of the Invention

The present invention relates to an apparatus and method for cleaning papermachine clothing and particularly, but not exclusively, to an apparatus and method for cleaning press felts.

2. Description of the Related Art

Generally speaking papermaking machines are made up of three sections, namely the forming, pressing and drying sections. In each section a fabric belt is used to transport a continuous paper sheet through the papermaking equipment as the paper is being manufactured. When in use, the fabric belts become contaminated with components from the pulp such as aluminium hydroxide, natural wood resin components, resin components, resin size, latex binders and inorganic coating pigments. The problem of belt contamination is increasing as the use of recycled paper in the pulp becomes more common. Debris on the belt may contaminate the paper product supported by the belt.

The traditional method of cleaning papermaking belts, such as press felts, is to direct jets of high pressure water onto the paper stock carrying surface of the felt from an apparatus which traverses the cross-machine direction of the belt. The water penetrates into the body of the felt and returns out through the paper side of the felt. As the water returns out through the felt surface, felt fibre ends are brought out from the felt. These shredded felt fibres contaminate the paper product supported by the belt.

SUMMARY OF THE INVENTION

The present invention has been made from a consideration of this problem.

According to a first aspect of the present invention there is provided a papermachine clothing cleaning apparatus comprising means for directing a fluid stream towards a first surface of the papermachine clothing and first and second bodies, said bodies respectively being located at opposite surfaces of the papermachine clothing, one of said bodies being movable relative to the other so as to form a press adjacent the area of papermachine clothing to be impacted by the fluid stream.

According to a second aspect of the present invention there is provided a method of cleaning papermachine clothing using apparatus comprising means for directing a fluid stream towards a first surface of the papermachine clothing and first and second bodies, said bodies respectively being located at opposite surfaces of the papermachine clothing, the method comprising the steps of moving one of said bodies relative to the other so as to form a press adjacent the area of papermachine clothing being impacted by the fluid stream.

The press force applied to the first surface of the papermachine clothing is large enough to balance the internal fluid pressure that is developed in the area of the papermachine clothing being cleaned.

The cleaning fluid is preferably water, optionally containing cleaning agents, such as detergents and anti-redeposition agents. The fluid stream is preferably injected into the papermachine clothing, such as a felt, under high pressure.

The first body preferably comprises a plate having a number of holes therethrough. The plate is pressed against the felt during the cleaning operation. The second body may, for example, be a plate, bar or roller.

The rate of fluid injection into the papermachine clothing can be regulated by regulating the water pressure and/or by selecting one press plate from a range of such plates having different numbers of holes. The conditioning effect of the felt cleaning apparatus may be influenced by selecting one press plate from a range of such plates having different patterns of holes and/or hole angles.

The pressure of the cleaning fluid intake will depend on the velocity, total volume saturation capability, water content and fibre orientation of the incoming belt, all of which will vary according to the type of papermachine clothing or papermachine press section used.

If the rate of fluid flow is increased to levels above the capacity of the papermachine clothing, an enforced lateral water flow in the felt can be achieved. The lateral flow can also contribute to the conditioning of the felt.

The cleaning liquid or vapour may be heated to a temperature greater than that of the surrounding working environment. The heating may take place by means of a heat source in the region of the cleaning fluid reservoir, and/or by means of one or more heat exchangers utilizing the spent cleaning fluid and/or by means of one or more heating elements.

The press force from the plate onto the felt can be achieved by using the high pressure fluid itself as the hydraulic media or by a separately operating hydraulic system. The use of the high pressure fluid simultaneously as a cleaning fluid and as the hydraulic media has the advantage of preventing compression of the felt unless cleaning fluid is being directed onto the belt. Furthermore, the regulation of fluid flow by changing the water pressure simultaneously gives a corresponding change in press force.

The first body, or plate, is preferably made of metal, such as steel, or a ceramic material. The plate may not span the entire belt width, but instead may traverse the cross-machine direction of the felt in a reciprocating manner. The high pressure water injection unit is intended to be used during normal operation of the felt, thereby traversing in the cross-machine direction over the entire felt width. The traversing speed has to be chosen so as to cover the whole felt area. Means may be provided to arrest the cleaning head at determined locations for localized cleaning of areas of high contaminate concentrations, which may have been detected by known techniques, such as on-line air permeability profiles for the belt. Alternatively, the plate or a plurality of such plates may span substantially the full width of the belt. One or more apparatus may be provided per belt. The plate of each apparatus may move in a direction substantially perpendicular to the felt. This aids the periodic cleaning and general maintenance of the apparatus.

As the water injection will saturate the felt in a traversing stroke, a suction device must be incorporated in the unit, and especially in the case of fast-running paper machines (speeds over 1000 m/min). This suction unit preferably has a width slightly wider than the press body and ideally has an extended length in the belt running direction. The suction device must be capable of reducing the water content in the belt to normal levels in order not to disturb or influence the pressing of the paper sheet. The intake of cleaning fluid may be continuously accelerated/decelerated so as to dislodge contaminants that are strongly bonded to the fabric surface.

As the unit has to traverse the entire machine width, ideally all moving parts are located on the same side of the belt, preferably working from the paper side. But it is of course also possible to inject fluid from one side and apply suction from the other. Suction from the other side would reduce, still further, the problems of fibre shredding.

BRIEF DESCRIPTION OF THE DRAWINGS

In order that the present invention may be more readily understood a specific embodiment thereof will now be described by way of example only with reference to the accompanying drawings in which.

DETAILED DESCRIPTION OF THE PREFERRED EMBODIMENTS

Figure 1:
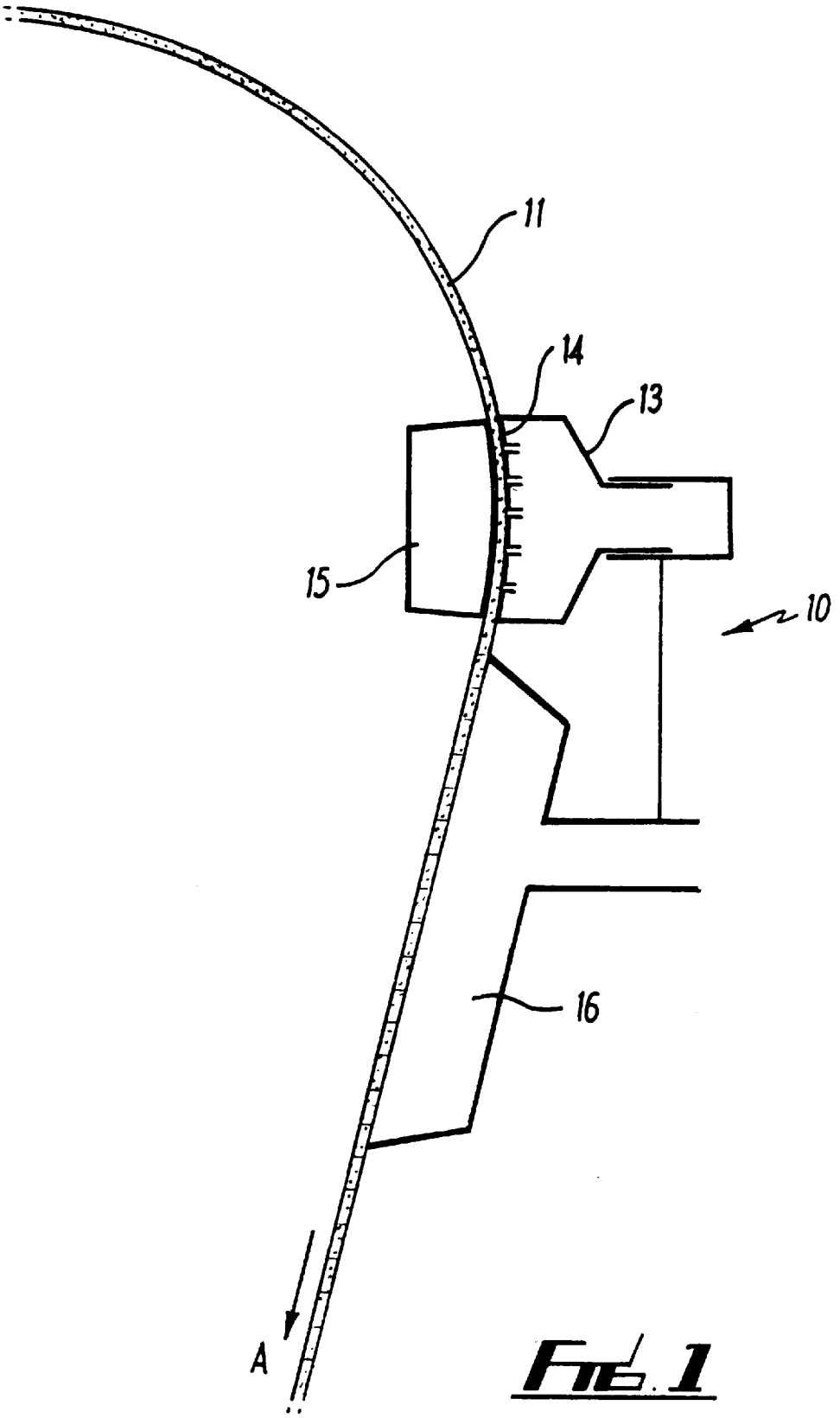
FIG. 1 is a diagrammatic illustration of one apparatus in accordance with the present invention.
Figure 2:
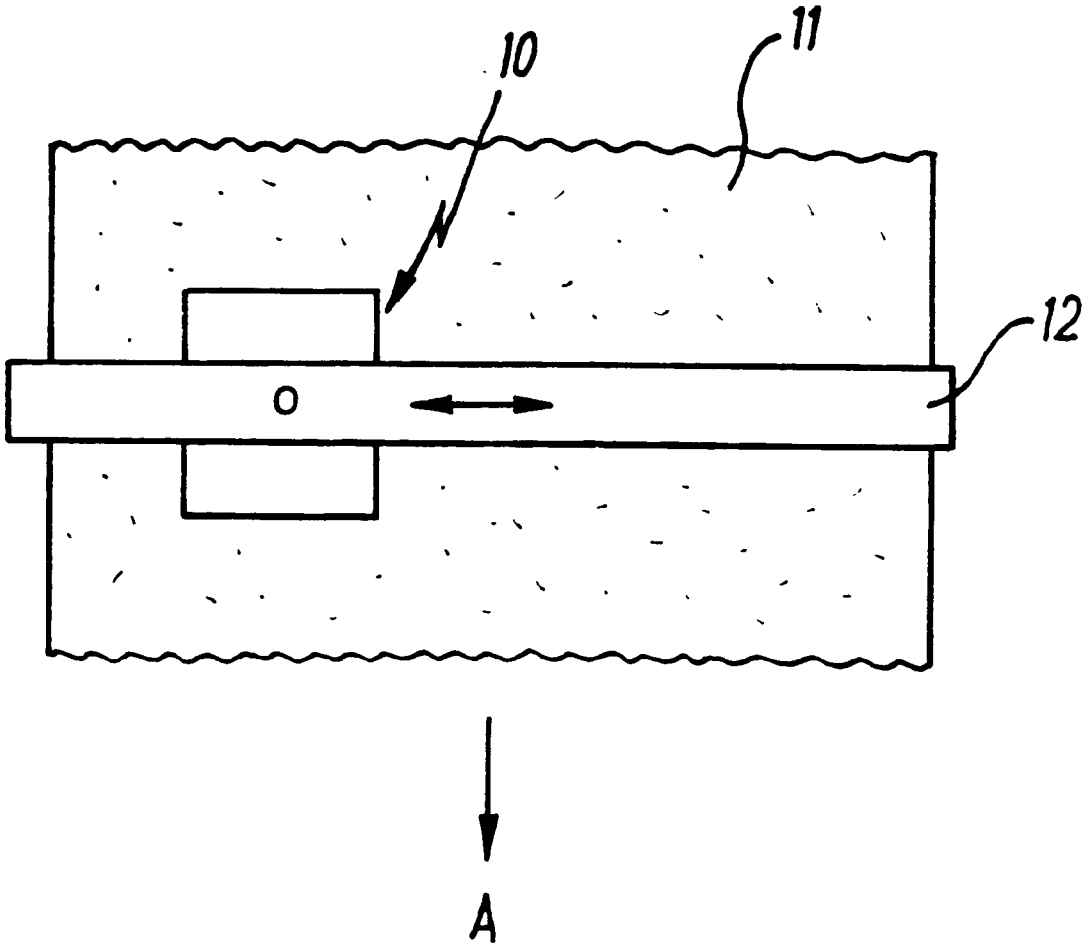
FIG. 2 is a plan view of the apparatus of FIG. 1 in position on a papermaking machine.

Referring to the drawings, an apparatus 10 for the on-line cleaning of papermachine clothing 11, such as press felts, comprises a unit mounted for reciprocating movement along an arm 12 extending over a papermachine in the cross machine direction. The unit 10 comprises a fluid injection nozzle 13 to which a cleaning fluid is fed via an input pipe. The cleaning fluid is directed through an apertured plate 14 onto the side of the papermachine clothing 11 that is operative to support the paper. The unit 10 is urged towards the papermachine clothing via a hydraulic mechanism such that the plate 14, in combination with a body 15, such as a plate, concave element or a roll, provided on the opposite side of the papermachine clothing, forms a press. Water is urged into the papermachine clothing under pressure. The press force applied to the papermachine clothing is large enough to balance the internal fluid pressure that is developed in the area of the papermachine clothing being cleaned.

The invention further comprises a suction device 16, located downstream of the fluid injection device, which removes cleaning fluid, under suction, from the papermachine clothing 11 after cleaning.

In use, following the departure of the paper sheet from the papermachine clothing belt 11, the papermachine belt 11 is fed through the gap defined by the plate 14 and body 15. It is noted that the paper web does not pass through the gap. As the papermachine belt 11 moves in the direction of arrow "A" the unit 10 traverses the belt width with a reciprocating motion such that substantially all of the belt passes through the gap and is subjected to cleaning.

It is to be noted that the embodiment of the invention disclosed herein is by way of illustration only. Many modifications and variations are possible.

I claim:

1. A papermachine clothing cleaning apparatus for cleaning papermachine clothing having a first surface and a second surface opposite the first surface, comprising means for directing a fluid stream towards an area of the first surface of the papermachine clothing to be impacted, a first body located at the first surface of the papermachine clothing and aligned with the area of papermachine clothing to be impacted by the fluid stream, and a second body located at the second surface and aligned with the first body, one of said first and second bodies being movable toward the other one of said first and second bodies so that the first body and second bodies form a press adjacent the area of papermachine clothing to be impacted by the fluid stream.

2. The papermachine clothing cleaning apparatus as claimed in claim 1, wherein the force applied to the papermachine clothing by the press is sufficient to balance the internal fluid pressure that is developed in the area of the papermachine clothing being cleaned.

3. The papermachine clothing cleaning apparatus as claimed in claim 1, wherein the first body comprises a plate having a number of holes therethrough that allow the fluid stream to pass through the first body.

4. The papermachine clothing cleaning apparatus as claimed in claim 1, wherein the second body comprises a plate, bar or roller.

5. The papermachine clothing cleaning apparatus as claimed in claim 1, further comprising regulating means connected to the means for directing a fluid stream, the regulating means regulating the rate of fluid flow onto the papermachine clothing.

6. The papermachine clothing cleaning apparatus as claimed in claim 1, further comprising heating means connected to the means for directing a fluid stream, the heating means heating said fluid.

7. The papermachine clothing cleaning apparatus as claimed in claim 1, further comprising a hydraulic system connected to the first and second bodies for moving one of the first and second bodies.

8. The papermachine clothing cleaning apparatus as claimed in claim 7, wherein the means for directing a fluid stream is connected to the hydraulic system so that the cleaning fluid for cleaning the papermachine clothing also serves to operate said hydraulic system.

9. The papermachine clothing cleaning apparatus as claimed in claim 1, the first body or a plurality of such bodies span substantially the full width of the papermachine clothing.

10. The papermachine clothing cleaning apparatus as claimed in claim 1, further comprising an arm for moving the cleaning apparatus to traverse a cross-machine direction of the papermachine clothing in a reciprocating manner.

11. The papermachine clothing cleaning apparatus as claimed in claim 10, wherein motion of the first body may be arrested at a specific location across the cross-machine direction of the papermachine clothing.

12. The papermachine clothing cleaning apparatus as claimed in claim 1, further comprising a suction device positioned downstream from the means for directing a fluid stream for removing cleaning fluid from the first surface of the papermachine clothing.

13. A method of cleaning papermachine clothing having a first surface and a second surface opposite the first surface using an apparatus having means for directing a fluid stream towards an area of the first surface of the papermachine clothing to be impacted and first and second bodies, said first and second bodies respectively located at the first and second surfaces of the papermachine clothing, the method comprising the steps of moving one of said bodies toward the other so that the first and second bodies form a press adjacent the area of papermachine clothing being impacted by the fluid stream.

14. The method of claim 13, further comprising the step of moving the first and second bodies to traverse the papermachine clothing.

15. A cleaning apparatus for cleaning papermachine clothing having a first surface and a second surface opposite the first surface, the apparatus comprising:

a nozzle directing a fluid stream towards the first surface of the papermachine clothing;

a first body located at the first surface of the papermachine clothing, a second body located at the second surface and aligned with the first body, means connected to one of said first and second bodies for moving said one of said first and second bodies so that the first body and second body press the papermachine clothing; and, an arm connected to said means for supporting said first and second bodies to traverse the papermachine clothing.

16. The papermachine clothing cleaning apparatus as claimed in claim 15, wherein the first body comprises a plate having a number of holes therethrough that allow the fluid stream to pass through the first body.

17. The papermachine clothing cleaning apparatus as claimed in claim 15, said device comprising a hydraulic system connected to the first and second bodies for moving one of the first and second bodies.

18. The papermachine clothing cleaning apparatus as claimed in claim 15, wherein movement of the first body may be arrested at a specific location across the cross-machine direction of the papermachine clothing.

19. The papermachine clothing cleaning apparatus as claimed in claim 15, further comprising a suction device positioned downstream from the means for directing for removing cleaning fluid from the first surface of the papermachine clothing.

20. The papermachine clothing cleaning apparatus as claimed in claim 15, wherein the second body comprises a plate, bar or roller.

* * * * *